United States Patent [19]

Yamashita

[11] 4,203,798

[45] May 20, 1980

[54] LABELING DEVICE

[75] Inventor: Kyoichi Yamashita, Yokohama, Japan

[73] Assignee: Koyo Jidoki Corporation Ltd., Yokohama, Japan

[21] Appl. No.: 930,755

[22] Filed: Aug. 3, 1978

[30] Foreign Application Priority Data

Aug. 3, 1977 [JP] Japan ..... 52/93655

[51] Int. Cl.[2] ..... B65C 9/00; B65C 11/04

[52] U.S. Cl. ..... 156/567; 156/571; 156/578

[58] Field of Search ..... 156/571, 578, 567, DIG. 34, 156/DIG. 35, 521

[56] References Cited

U.S. PATENT DOCUMENTS 4,108,710 8/1978 Hoffmann ..... 156/567

*Primary Examiner*—Douglas J. Drummond

*Attorney, Agent, or Firm*—Armstrong, Nikaido, Marmelstein & Kubovcik

[57] ABSTRACT

An improved labeling device of the type including a rotatable transfer drum for transferring containers onto which labels are to be affixed; an adhesive coating drum for applying an adhesive coating; and a label supply drum for first holding and then releasing labels. The improvement comprises arranging the components such that the containers carried by the rotatable container transfer drum first contact the adhesive coating drum and subsequently the adhesive coated containers while still carried by the container transfer drum are brought into contact with labels carried by the label supply drum, thereby making it possible to apply labels to containers at high-speeds and to use strong adhesives.

4 Claims, 5 Drawing Figures

LABELING DEVICE

BACKGROUND OF THE INVENTION

1. Field of the Invention

The invention concerns a labeling device, and more particularly, a device for applying adhesive to an entire label while preventing the label from sticking to the paste drum.

2. Description of the Prior Art

FIG. 4 illustrates a conventional labeling device.

This device consists of a label suction drum (a) which utilizes an interruptable negative pressure for first holding and later releasing individual labels (f), a paste drum (b) and adjustably positioned adjacent to the aforementioned label suction drum (a) for applying an adhesive paste to each successive label (f), a label dispenser (c) adjustably positioned adjacent to drum (a), and a rotatable container transfer drum (e) for supporting containers (d) and bringing the containers into contact with individual labels held by the label suction drum for facilitating attachment of the labels (f) to the containers (d).

This type of labeling device makes it difficult to completely coat the individual labels with adhesive, as solidly coated labels are very likely to become attached to the paste drum (b) instead of remaining on the label suction drum (a) for transfer to the containers (d).

This phenomena is due to the fact that the negative pressure exerted on the labels by the suction drum (a) is weaker than the adhesive strength of the glue.

In an attempt to remedy the above-discussed problem, it has been known to insert a comb-like metal piece between the paste drum (b) and the labels (f) carried by the rotatable transfer device, to peel labels from the paste drum (b) and replace them on the label suction drum (a). With this type of device, parallel grooves (g) from recessed bands on the circumference of the drum (b) prohibit glue from being applied to that part of the label coinciding with the grooves, as illustrated in FIG. 5.

In other words, the labels (f) are coated horizontally with multiple stripes of glue. The teeth of the comb-like device push against the uncoated parts of the labels so that labels are released from the paste drum (b) and transferred to the label suction drum (a).

Generally, this type of device is adequate. However, in the following it may prove deficient:

1. In the case of containers likely to be used in damp places, i.e., shampoos and detergents, the uncoated stripes absorb moisture and swell, creating a poor appearance and reducing the value of the goods.

2. In the case of smooth-surfaced containers, such as plastic, hot-melt type strong adhesives are needed. Strong adhesives such as hot-melt type are beginning to predominate the field. However, these strong adhesives make separation of labels from the paste drum difficult, especially in high speed labeling operations.

SUMMARY OF THE INVENTION

An object of the invention is to apply adhesives to the entire label while resolving the prior-art label-paste drum separation problem.

Another object of the invention is to provide a means for absorbing pressure generated when the containers carried by the container transfer drum are brought into contact with the adhesive coating drum.

Still another object of the invention is to provide an even coating of adhesive on the adhesive coating drum.

A further object of the invention is to provide a means for first picking up and holding a single label from a supply of labels and then bringing the single label into contact with an adhesive coated container carried by the container transfer drum and releasing the label.

More specifically, the present invention is directed to an improved labeling device wherein containers carried by a container transfer means are first brought into contact with an adhesive coating means thereby applying adhesive to each container, and subsequently bringing each adhesive coated container into contact with a label holding drum thereby applying a label to each adhesive coated container.

BRIEF DESCRIPTION OF THE DRAWINGS

These and other objects and advantages will become more fully apparent as the following description is read in conjunction with the drawings, wherein.

DESCRIPTION OF THE PREFERRED EMBODIMENTS

Figure 1:
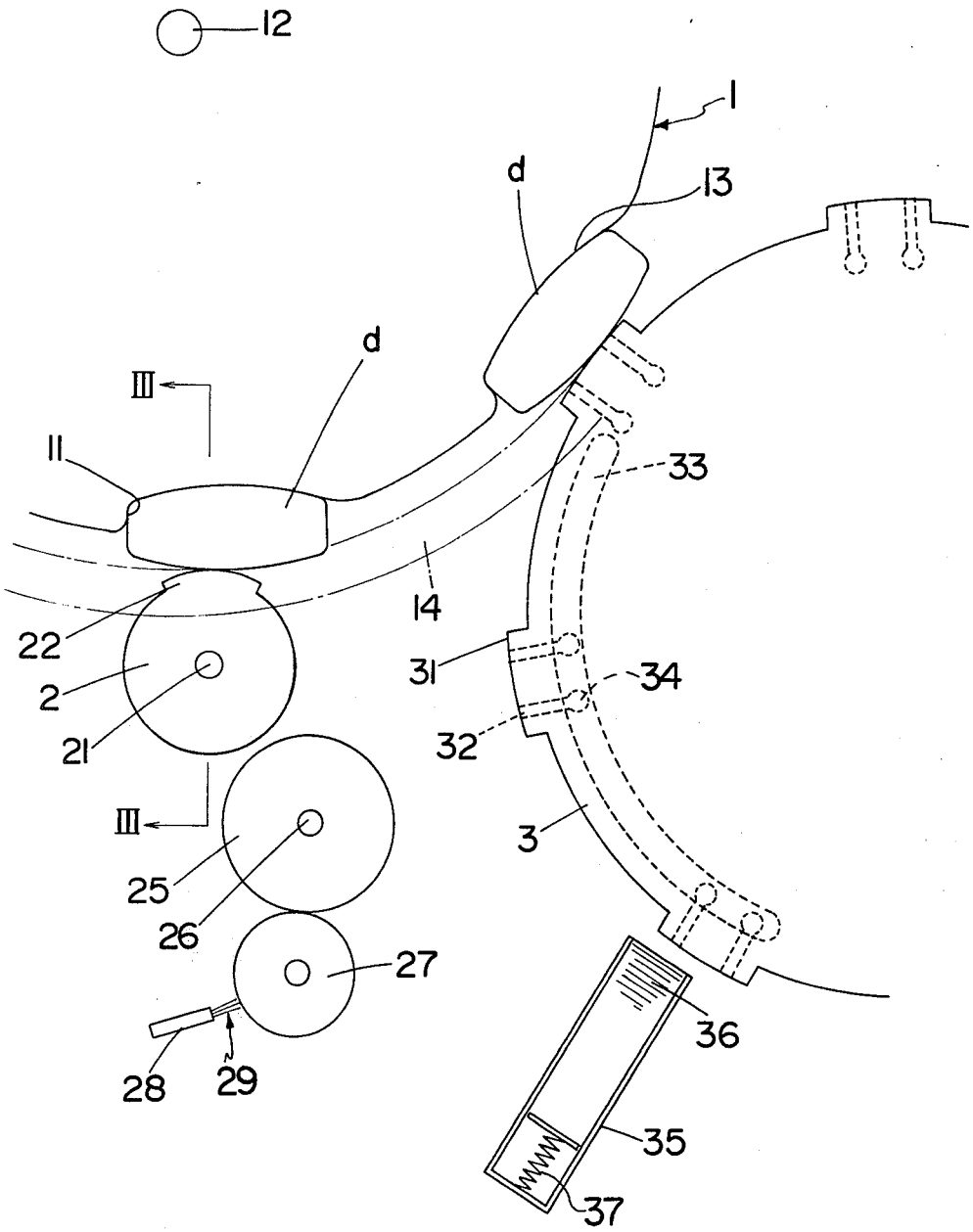
FIG. 1 is a plan view of one embodiment of the labeling device of the present invention.

Referring now to the drawings, FIG. 1 illustrates a labeling device of the present invention comprising a rotatable container transfer drum 1, an adhesive coating drum 2, and a label suction drum 3.

As seen in FIG. 1, the container transfer drum 1, having recessed alcoves 11 on its circumference for holding the containers (d) rotates about an axis 12. The alcoves are recessed so as to match the cross-sectional shape of containers, and are provided with padded interiors 13 for elasticity. The padded interior 13 provides a cushion for preventing container breakage when a relatively high pressure is exerted on the containers during application of the adhesives and labels.

A guide 14 is mounted along the periphery of the container transfer drum 1 for assisting in holding the containers. Thus, the containers (d) are sandwiched between container transfer drum 1 and the guide 14 during the labeling operation.

The adhesive coating drum 2 is in the form of a cylinder rotating about an axis 21, and has a protrusion 22 formed on its circumference. The adhesive coating drum 2 is positioned so that the protrusion 22 is aligned with and forcefully engages the sides of the containers by virtue of being overlappingly positioned with respect to the containers. The previously mentioned cushions 13 absorb the pressure generated by the overlapped positioning of of the protrusion 22 and the containers (d).

Figure 2:
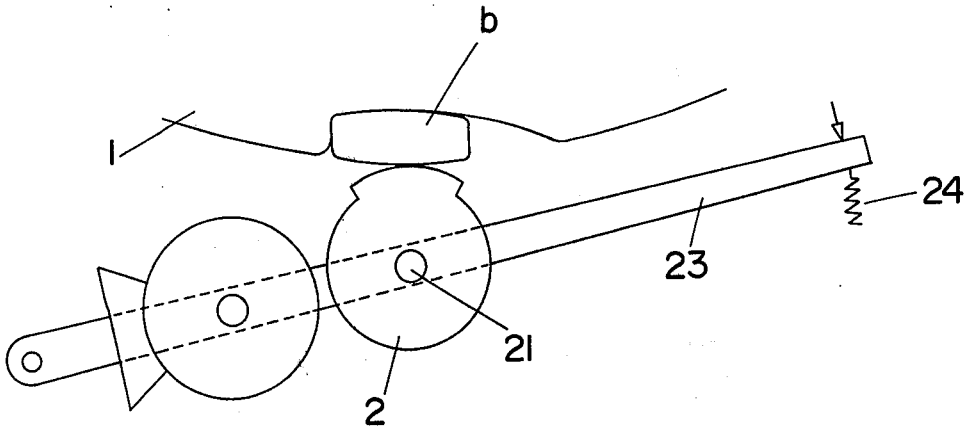
FIG. 2 illustrates another embodiment according to the invention.
Figure 3:
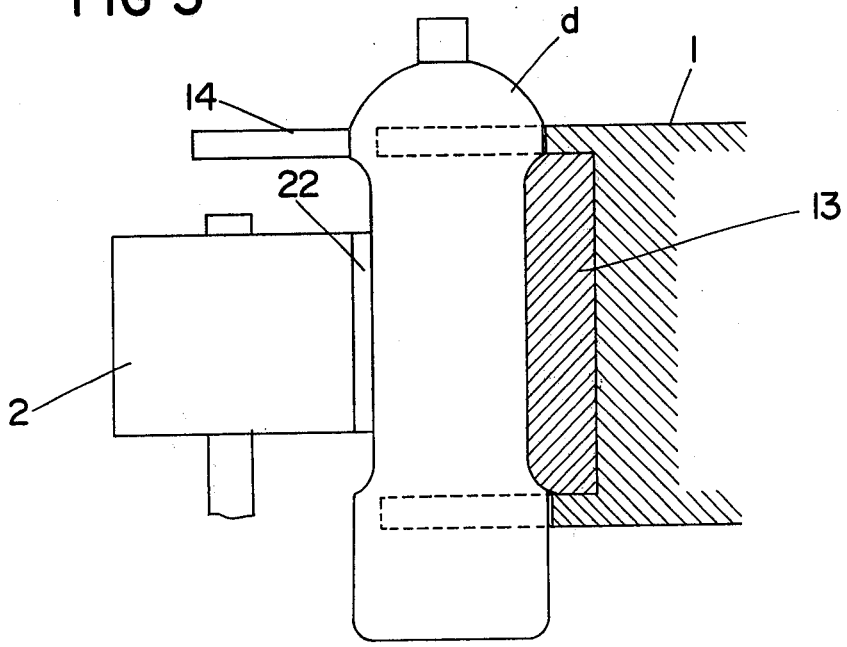
FIG. 3 is a sectional view taken along the line III—III in FIG. 1.
Figure 4:
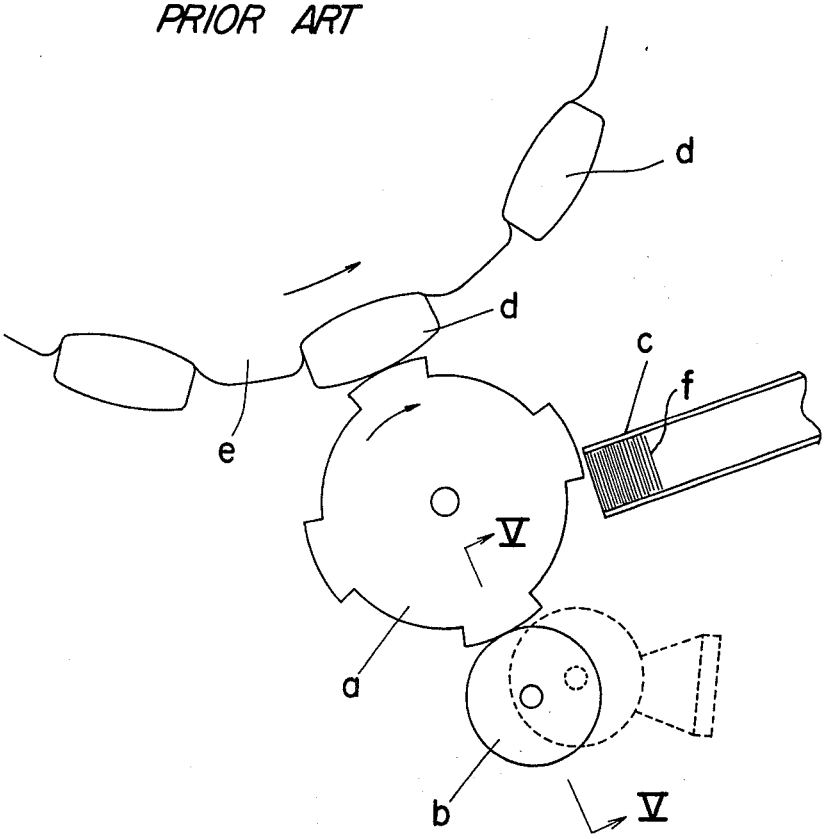
FIG 4 PRIOR ART
FIG. 4 illustrates a conventional labeling device.
Figure 5:
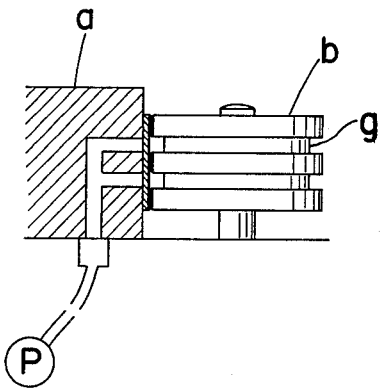
FIG 5 PRIOR ART
FIG. 5 is a sectional view taken along the line V—V in FIG. 4.

In the case of containers having very little elasticity, such as glass, the adhesive coating drum 2 is mounted on a slotted and pivoted arm or rod 23 provided with a spring 24 which pushes the arm 23 and the adhesive coating drum 2 against the containers as illustrated in FIG. 2. With this device the adhesive coating drum 2 can recede when contacting hard containers, to optimize the contact pressure between the drum and the containers.

A middle drum 25 is provided which is positioned so as to also make contact with the protrusion 22 on the coating drum 2. The middle drum 25 rotates about an axis 26. With hot-melt type adhesives, a heater can be placed inside the drum.

An adhesive supply drum 27 is provided which is positioned in contact with the middle drum 25.

An adhesive supply nozzle 28 is located next to the adhesive supply drum 27. Adhesive material 29 is sprayed through the nozzle 28 to coat the surface of the supply drum 27.

The sprayed adhesive is spread evenly on the surface of the adhesive supply drum 27 through its contact with the middle drum 25. The evenly spread adhesive material 29 is eventually applied to the protrusion 22 of the coating drum 2.

The label suction drum 3 has protrusions 31 along its circumference to which labels are held by suction. The label suction drum 3 rotates about an axis and is positioned so that as it rotates, the protrusion 31 are brought into contact with the containers supported on the container transfer drum 1.

Each protrusion 31 has a length corresponding to the length of the labels (f) and has more than one suction port 32 on the surface.

A suction distribution chamber 33 is in fluid contact with the end of the label suction drum. The suction ports 32 have openings 34 at the end of the label suction drum 3. The openings 34 of the ports 32 move over the chamber 33 as the label suction drum rotates.

The suction distribution chamber 33 is connected to a pump (not shown) which creates a negative pressure or suction so that when suction ports pass over the chamber, suction is applied to them.

The label suction drum 3 is positioned in such a way that the revolving trace of each protrusion 31 slightly overlaps with that of each container (d). The extent of overlap is adjusted by cushion absorption and/or by temporarily denting the containers.

A label dispenser 35 lies in close proximity to the label suction drum 3.

The dispenser moves periodically to and from the circumference of the label suction drum 3 by means of a well known combination of link and disc or cam and cam follower arrangement.

The labels 36 are loaded into the dispenser 35 in an upright position and are pressed toward the suction drum 3 by a slight pressure produced by a spring 5.

The negative pressure chamber 33 in contact with the end of the suction drum 3 stretches along a line concentric with the drum 3, and runs from the point where the suction drum comes in contact with the label holder 35 to the point where the drum comes closest to the container transfer drum 1.

Thus, the suction ports 32 open through the protrusion of the suction drum 3 are not always subject to the negative pressure during revolution of the drum 3. The suction ports on each protrusion begin to have a negative pressure for holding a label immediately before contacting the label holder 35, and releases the label in the process of regaining atmospheric pressure as the ports contact the containers (d) supported on the container transfer drum 1.

The operation of the labeling device will now be described. The containers (d) held in the alcoves 11 of the container transfer drum 1 move into close relation to the adhesive coating drum 2 with the exposed sides of the containers (d) in contact with the guide.

The revolution cycle of each alcove 11 of the container transfer drum is synchronized with the cycle of each protrusion 22 of the coating drum 2. As a result, the side of the container (d) awaiting a label is sufficiently coated with adhesive with the cooperation of the middle drum 25.

After being coated with the adhesive, the containers (d) are rotated toward the label suction drum 3.

The suction protrusion 31 of the label suction drum 3, in coordination with the containers (d), picks up labels 36 from the label holder 35. The labels are then pressed onto the adhesive coated portion of the containers (d) with some pressure generated by the break of negative pressure at the point of contact between labels 36 and containers (d).

In practical applications, a set of guide conveyors and/or set of guide rollers placed to the rear of the above-mentioned contact point as a following step sandwiches and presses the containers with labels from both sides for a better adhesion.

Compared to conventional labeling devices, the special features of this invention become clear. That is, until now, conventional labeling methods have applied adhesives to labels which in turn are pressed onto containers. In this arrangement, the container transfer drum operates in coordination with only the label suction drum. In contrast, the present invention constitutes a setup in which adhesives are directly applied to the containers with labels being pressed into place on pre-adhesived containers.

In the process of the present invention, the container transfer drum is located so that the drum first comes into contact with the adhesive coating drum and later with the label suction drum.

By eliminating the process of transferring adhesive coated labels, the present invention makes the label separating process unnecessary. In contrast to the conventional method in which labels are partially coated with adhesives to avoid their contact with the comb-like metal device, this invention makes it possible for adhesives to be applied to the entire specified area of the containers, and later pressed on for lasting adhesion. This results in glued labels that do not swell in moisture, which in turn preserves the marketability of goods.

Further, in conventional labeling methods the use of hot-melt type adhesives run the risk of causing the labels to become inseparably glued on the coating drum, and thus the use of strong adhesives has been limited; while the present invention, through the elimination of the label coating stage by applying adhesives directly onto containers, makes it possible to conveniently use strong adhesives.

The present invention may be embodied in other specific forms without departing from the spirit or essential characteristics thereof. The presently disclosed embodiments are therefore to be considered in all respects as illustrative and not restrictive the scope of the invention being indicated by the appended claims, rather than the foregoing description, and all changes which come within the meaning and range of equivalency of the claims are, therefore, to be embraced therein.

What is claimed is:

1. In a labeling device of the type comprising:

a rotatable container transfer drum means for transferring containers onto which labels are to be affixed;

an adhesive coating drum means for applying an adhesive material; and a label supply drum means for first holding labels and then releasing them, said label supply drum means comprising a drum having protrusions spaced along its periphery, suction outlets to ports on the surface of said protrusions, and valve means for alternately applying and releasing suction applied to said suction ports, thereby first gripping and then releasing said labels;

wherein the improvement comprises contacting the containers carried by said rotatable container transfer drum means with said adhesive coating drum means, thereby applying adhesive to said containers and subsequently contacting said adhesive coated containers while still carried by said container transfer drum means to said labels supported on said label supply drum means, thereby applying labels to said adhesive coated containers.

2. In an improved labeling device of the type claimed in claim 1 wherein said container transfer drum means includes cushioning means for absorbing pressure generated during contact of said adhesive coating drum means with said containers carried by said container transfer drum means.

3. In an improved labeling device of the type claimed in claim 1 wherein said adhesive coating drum means comprises a pivoted arm mounting an adhesive roller and a spring for biasing said pivoted arm and adhesive roller in the direction of said container transfer drum means.

4. In an improved labeling device of the type as claimed in claim 1 wherein said adhesive coating drum means comprises:

an adhesive spray nozzle;

an adhesive supply drum receiving said adhesive from said adhesive spray nozzle;

a middle drum pressing against and receiving adhesive from said adhesive supply drum; and a coating drum, said coating drum including a protrusion, said protrusion intermittantly contacting said middle drum and said containers carried by said container transfer means.

* * * * *